US006544398B2

(12) United States Patent
Uchida et al.

(10) Patent No.: US 6,544,398 B2
(45) Date of Patent: Apr. 8, 2003

(54) NON-CYANIDE-TYPE GOLD-TIN ALLOY PLATING BATH

(75) Inventors: Ei Uchida, Kobe (JP); Takashi Okada, Kobe (JP)

(73) Assignee: Ishihara Chemical Co., LTD, Kobe (JP)

( * ) Notice: Subject to any disclaimer, the term of this patent is extended or adjusted under 35 U.S.C. 154(b) by 0 days.

(21) Appl. No.: 09/971,810

(22) Filed: Oct. 9, 2001

(65) Prior Publication Data

US 2002/0063063 A1 May 30, 2002

(30) Foreign Application Priority Data

Oct. 11, 2000 (JP) ..... 2000-310105

(51) Int. Cl.[7] ..... C25D 3/62; C25D 3/60; C23C 18/00

(52) U.S. Cl. ..... 205/247; 205/252; 205/253; 106/1.26

(58) Field of Search ..... 205/247, 252, 205/253, 106; 106/1.26; 428/544

(56) References Cited

U.S. PATENT DOCUMENTS 4,013,523 A * 3/1977 Stevens et al. ..... 204/43 G
6,245,208 B1 * 6/2001 Ivey et al. ..... 205/248

FOREIGN PATENT DOCUMENTS

JP 52-081032 7/1977
JP 08-053790 2/1996

* cited by examiner

*Primary Examiner*—Edna Wong
(74) *Attorney, Agent, or Firm*—Armstrong, Westerman & Hattori, LLP

(57) ABSTRACT

The present invention provides a non-cyanide-type gold-tin alloy plating bath comprising: (i) at least one water-soluble gold compound, (ii) at least one completing agent for gold, (iii) at least one water-soluble tin compound, and (iv) at least one component selected from the group consisting of cationic macromolecular surfactants and cationic macromolecular compounds. By using the non-cyanide-type gold-tin alloy plating bath of the present invention, a gold-tin alloy plating film having good brightness, reflow properties and the like can be formed.

5 Claims, No Drawings

NON-CYANIDE-TYPE GOLD-TIN ALLOY PLATING BATH

BACKGROUND OF THE INVENTION

1. Field of the Invention

The present invention relates to a gold-tin alloy plating bath that does not contain cyanide compounds.

2. Description of the Related Art

Of gold-tin alloy plating films, one having a eutectic composition, i.e. an Au:Sn ratio of 80:20 by weight, for example, has a melting point of 280° C., and is widely used as a low-melting-point high-strength brazing material, for example when joining various chip components to semiconductor substrates, or when sealing packages by brazing. Moreover, gold-tin alloy plating films have good corrosion resistance and appearance, and are thus also used in white gold plating for decorative purposes and the like.

Conventionally, so-called cyanide type plating baths in which a cyanide compound is added to stabilize the gold ions are used as gold-tin alloy plating baths. However, cyanide compounds are harmful to the human body, and hence there are large problems in terms of work safety and environmental protection.

There are thus calls for non-cyanide-type gold-tin alloy plating baths that do not contain cyanide compounds. However, the current state of affairs with conventionally used non-cyanide-type gold-tin alloy plating baths is that there are cases in which the electrodeposited film is mat rather than bright deposit, or the electrodeposit is coarse and a film cannot be formed, and hence it is not possible to form a gold alloy film of sufficient commercial value.

SUMMARY OF THE INVENTION

A principal object of the present invention is to provide a non-cyanide-type gold-tin alloy plating bath which is capable of forming a gold-tin alloy plating film that has good brightness, reflow properties and the like.

The inventors of the present invention carried out assiduous studies toward attaining the above object, and as a result arrived at the present invention after discovering that if a cationic macromolecular surfactant or a cationic macromolecular compound is added to a non-cyanide-type gold-tin alloy plating bath containing a water-soluble gold compound, a complexing agent for gold and a water-soluble tin compound, the gold-tin alloy film formed from the plating bath has excellent brightness and good reflow properties.

The present invention thus provides a non-cyanide-type gold-tin alloy plating bath, a gold-tin alloy plating method, and an article having formed thereon a gold-tin alloy plating film, as follows.

1. A non-cyanide-type gold-tin alloy plating bath comprising:
   (i) at least one water-soluble gold compound,
   (ii) at least one complexing agent for gold,
   (iii) at least one water-soluble tin compound, and
   (iv) at least one component selected from the group consisting of cationic macromolecular surfactants and cationic macromolecular compounds.
2. The non-cyanide-type gold-tin alloy plating bath according to item 1, wherein the cationic macromolecular surfactant is a quaternary ammonium salt of a diallylamine polymer.

3. The non-cyanide-type gold-tin alloy plating bath according to item 1, wherein a mixture of at least one water-soluble stannous compound and at least one water-soluble stannic compound is used as the water-soluble tin compound.
4. The non-cyanide-type gold-tin alloy plating bath according to item 1, further comprising at least one additive selected from the group consisting of complexing agents for tin, masking agents, oxidation inhibitors, brightening agents, semi-brightening agents, pH regulators, buffering agents and electrically conductive salts.
5. A gold-tin alloy plating method comprising the step of applying an electric current, using an article to be plated as a cathode, in the non-cyanide-type gold-tin alloy plating bath according to any of items 1 through 4.
6. An electronic component having a gold-tin alloy plating film formed thereon using the method according to item 5.

The non-cyanide-type gold-tin alloy plating bath of the present invention contains as essential components (i) at least one water-soluble gold compound, (ii) at least one complexing agent for gold, (iii) at least one water-soluble tin compound, and (iv) at least one component selected from the group consisting of cationic macromolecular surfactants and cationic macromolecular compounds.

Following is a more detailed description of the components contained in the plating bath of the present invention.

(i) Water-soluble Gold Compound

Any water-soluble gold compound other than a cyanide can be used as a water-soluble gold compound in the present invention. Specific examples of water-soluble gold compounds include potassium chloroaurate, sodium chloroaurate, ammonium chloroaurate, gold potassium sulfite, gold sodium sulfite, gold ammonium sulfite, gold potassium thiosulfate, gold sodium thiosulfate and gold ammonium thiosulfate. Either a single water-soluble gold compound may be used, or two or more may be used mixed together.

The water-soluble gold compound concentration in the plating bath is preferably about 0.002 to 20 g per liter, more preferably about 0.5 to 10 g per liter, in terms of the amount of gold.

(ii) Complexing Agent for Gold

Any known complexing agent for gold(I) ion other than a cyanide can be used as a complexing agent for gold in the present invention. Specific examples of such complexing agents include sulfurous acid, and sulfites such as potassium sulfite, sodium sulfite, ammonium sulfite and alkaline earth metal sulfites; thiosulfuric acid, and thiosulfates such as potassium thiosulfate, sodium thiosulfate, ammonium thiosulfate and alkaline earth metal thiosulfates; and pyrophosphoric acid, and pyrophosphates such as potassium pyrophosphate, sodium pyrophosphate, ammonium pyrophosphate and alkaline earth metal pyrophosphates. Either a single gold complexing agent may be used, or two or more may be used mixed together.

The concentration of complexing agent for gold in the plating bath is preferably about 0.01 to 5 mol per liter, more preferably about 0.05 to 3 mol per liter.

(iii) Water-soluble Tin Compound

At least one compound selected from the group consisting of water-soluble stannous compounds and water-soluble stannic compounds can be used as the water-soluble tin compound(s) in the present invention.

Specific examples of the water-soluble stannous compounds include stannous salts of organic sulfonic acids such as methanesulfonic acid, ethanesulfonic acid, 2-propanolsulfonic acid and p-phenolsulfonic acid; stannous borofluoride; stannous sulfosuccinate; stannous chloride; stannous sulfate; and stannous oxide.

Specific examples of the water-soluble stannic compounds include stannic salts of the above-mentioned organic sulfonic acids; salts of metastannic acid such as is sodium metastannate, potassium metastannate; stannic sulfate; stannic chloride; stannic oxide; stannic carbonate; stannic acetate; stannic pyrophosphate; and stannic oxalate.

Either a single water-soluble tin compound may be used, or two or more may be used mixed together. In particular, by using one or more water-soluble stannous compounds and one or more water-soluble stannic compounds in combination, the stability of the gold-tin alloy plating bath can be improved, and the brightness and reflow properties of the plating film formed can also be improved. In this case, there are no particular limitations on the ratio of the water-soluble stannous compound content to the water-soluble stannic compound content, with it being possible, for example, for this ratio to be anywhere in a broad range of about 1:9 to 9:1 (by weight).

The total water-soluble tin compound concentration in the plating bath is preferably about 0.01 to 5 mol per liter, more preferably about 0.05 to 3 mol per liter, in terms of the amount of tin.

(iv) Cationic Macromolecular Surfactants and Cationic Macromolecular Compounds

It is necessarily to add at least one component selected from the group consisting of cationic macromolecular surfactants and cationic macromolecular compounds to the gold-tin alloy plating bath of the present invention. By including such an additive, the plating film formed from the plating bath can be given an excellent specular brightness, and moreover the reflow properties of the plating film can be improved.

Here, a "cationic macromolecular surfactant" is a cationic macromolecular compound that has a surface active function, whereas a "cationic macromolecular compound" is a cationic macromolecular compound that does not have a surface active function. It is preferable for each cationic macromolecular surfactant or cationic macromolecular compound to have a weight average molecular weight in a range of about 1,000 to 100,000.

An example of a cationic macromolecular surfactant that can be used is a quaternary ammonium salt of a polyvinyl compound obtained by polymerizing a vinyl monomer having an amino group and then reacting the obtained polymer with a quaternizing agent such as an alkyl halide. An example of a cationic macromolecular compound that can be used is a cationized polysaccharide.

Specific examples of a cationic macromolecular surfactant include a quaternary ammonium salt of a diallylamine polymer (for example, SHALLOL (trade name) made by DAI-ICHI KOGYO SEIYAKU Co., Ltd., or ADEKA CATIOACE (trade name) made by ASAHI DENKA KOGYO K.K.), a polyvinyl pyridinium salt, a polyvinyl piperidinium salt, a dialkylhydroxyalkylaminoalkyl ammonium polymer type surfactant (for example, HIMOLOC Q-101 (trade name) made by HYMO CORPORATION) and a cationized polyacrylamide. Specific examples of a cationic macromolecular compound include a quaternary-ammonium-salt-modified cellulose (for example, Leoguard G (trade name) made by LION CORPORATION) and a cationized starch. Of the above, a cationic macromolecular surfactant such as a quaternary ammonium salt of a diallylamine polymer is particularly preferable.

Such a quaternary ammonium salt of a diallylamine polymer is obtained by causing polymerization reaction of the vinyl linkages in the two allyl groups of a diallylamine to polymerize the diallylamine, and then quaternizing the obtained polymer using an alkyl halide or the like. The quaternary ammonium salt of diallylamine polymer represented by general formula (1) shown below is particularly preferable.

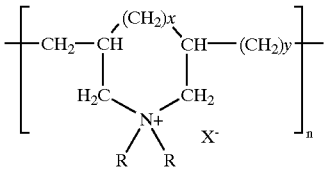

(1)

In general formula (1) above, R is hydrogen or a $C_1$, to $C_{12}$ alkyl group, and X is a halogen atom, —$OSO_3H$ or —$OCOCH_3$. x and y are each 0 or 1, provided that when x is 0, y is 1, and when x is 1, y is 0. n is an integer of at least 50.

In the general formula (1), the $C_1$ to $C_{12}$ alkyl group may be straight chain or branched, with specific examples including methyl, ethyl, n-propyl, isopropyl, n-butyl, isobutyl, sec-butyl, tert-butyl, pentyl, hexyl, heptyl, octyl, nonyl and decyl. Specific examples of the above-mentioned halogen atom include chlorine, bromine and iodine. The integer n is preferably about 50 to 500.

Either a single cationic macromolecular surfactant or cationic macromolecular compound as described above may be used, or two or more may be used mixed together, in which case this may be a combination of one or more cationic macromolecular surfactants and one or more cationic macromolecular compounds.

The total concentration of cationic macromolecular surfactant(s) and/or cationic macromolecular compound(s) in the plating bath is preferably about 0.001 to 10 g per liter, more preferably about 0.01 to 1.0 g per liter.

As described above, it is essential to use at least one component selected from the group consisting of cationic macromolecular surfactants and cationic macromolecular compounds in the present invention. If a non-cationic compound is used, such as a nonionic macromolecular surfactant obtained through addition condensation of ethylene oxide (EO) and/or propylene oxide (PO) to a $C_1$ to $C_{20}$ alkanol, phenol, naphthol, a $C_1$ to $C_{25}$ alkylphenol, a $C_1$ to $C_{22}$ aliphatic amine, a $C_1$ to $C_{22}$ aliphatic amide or the like, or a Pluronic surfactant, a polyvinyl alcohol or a polyacrylonitrile, then uneven electrodeposit will occur, or a coarse deposit will result, and hence it will not be possible to form a gold-tin alloy plating film having good brightness. Moreover, if a non-macromolecular cationic surfactant such as benzalkonium chloride, benzethonium chloride, a pyridinium salt or an imidazolium salt is used, then it will not be possible to obtain good effects.

Other Additives

Various additives such as complexing agents for tin, masking agents, oxidation inhibitors, brightening agents, semi-brightening agents, pH regulators, buffering agents and electrically conductive salts can be added to the gold-tin alloy plating bath of the present invention as required. Following is a description of these additives.

When a stannous compound is used as a water-soluble tin compound, the stannous ions will be stable in acidic conditions, but there will be a possibility of a white precipitate appearing as conditions of the plating bath approach or go beyond neutrality. To stabilize the stannous ions, it is thus preferable to add a complexing agent for tin. A known compound that acts as a complexing agent for tin can be used as such a complexing agent. Specific examples include ethylenediamine, ethylenediamine tetraacetic acid (EDTA), diethylenetriamine pentaacetic acid (DTPA), nitrilotriacetic acid (NTA), iminodiacetic acid (IDA), iminodipropionic acid (IDP), hydroxyethylethylenediamine triacetic acid (HEDTA), triethylenetetramine hexaacetic acid (TTHA), ethylenedioxybis(ethylamine)-N,N,N',N'-tetraacetic acid, succinic acid, citric acid, tartaric acid, glycolic acid, glycine, mercaptosuccinic acid, gluconic acid, glucoheptonic acid, gluconolactone, glucoheptonolactone, nitrilotrimethylphosphonic acid, and salts and derivatives thereof; and phosphoric acids such as pyrophosphoric acid and salts thereof.

Either a single tin complexing agent may be used, or two or more may be used mixed together. The total amount added is preferably about 0.01 to 5 mol per liter, more preferably about 0.05 to 1 mol per liter.

The gold-tin alloy plating film of the present invention is generally formed on a base metal such as copper, nickel or palladium. Due, for example, to exchange with gold ions in the plating bath, the base metal may be dissolved into the plating bath, in which case the dissolved metal may then precipitate. To prevent this, a masking agent that forms a complex with the dissolved metal may be added.

Examples of masking agents include hydroxy-carboxylic acids, polyamines, amino-alcohols and amino-carboxylic acids. Some of these masking agents also act as tin complexing agents.

Among masking agents, examples of hydroxy-carboxylic acids include citric acid, gluconic acid, tartaric acid, malic acid, lactic acid, and salts thereof. Examples of polyamines include methylenediamine, ethylenediamine, tetramethylenediamine, pentamethylenediamine, diethylenetriamine, tetraethylenepentamine, pentaethylenehexamine, hexaethyleneheptamine, hexamethylenetetramine, ethylenediaminetetramethylenephosphoric acid, diethylenetriaminepentamethylenephosphoric acid, aminotrimethylenephosphoric acid, and pentasodium aminotrimethylenephosphate. Examples of amino-alcohols include monoethanolamine, diethanolamine, triethanolamine, monopropanolamine, dipropanolamine, and tripropanolamine. Examples of amino-carboxylic acids include aminoacetic acid, aminopropionic acid, aminovaleric acid, glutamic acid, ornithine, cysteine, and N,N-bis(2-hydroxyethyl)glycine; amino-carboxylic acid compounds such as EDTA exemplified as the complexing agent for tin can also be used as the masking agent. Either a single masking agent may be used, or two or more may be used mixed together. The total amount added is preferably about 0.01 to 5 mol per liter, more preferably about 0.05 to 2 mol per liter.

Moreover, to prevent oxidation of $Sn^{2+}$ in the plating bath to $Sn^{4+}$, an oxidation inhibitor may be added. Specific examples of oxidation inhibitors include ascorbic acid and salts thereof, hydroquinone, catechol, resorcin, phloroglucin, cresolsulfonic acid and salts thereof, phenolsulfonic acid and salts thereof, and naphtholsulfonic acid and salts thereof.

A known compound can be used as a brightening agent. Specific examples include various aldehydes such as m-chlorobenzaldehyde, p-nitrobenzaldehyde, p-hydroxybenzaldehyde, 1-naphthaldehyde, benzylidenealdehyde, salicylaldehyde and paraldehyde, and vanillin, triazine, imidazole, indole, quinoline, 2-vinylpyridine and aniline. It is particularly effective if a brightening agent is used together with a surfactant.

A known compound can be used as a semi-brightening agent. Specific examples include thioureas, N-(3-hydroxybutylidene)-p-sulfanilic acid, N-butylidenesulfanilic acid, N-cinnamoylidenesulfanilic acid, 2,4-diamino-6-(2'-methylimidazolyl(1'))ethyl-1,3,5-triazine, 2,4-diamino-6-(2'-ethyl-4-methylimidazolyl(1'))ethyl-1,3,5-triazine, 2,4-diamino-6-(2'-undecylimidazolyl(1'))ethyl-1,3,5-triazine, phenyl salicylate, and benzothiazoles. Examples of benzothiazoles include benzothiazole itself, 2-methylbenzothiazole, 2-(methylmercapto)benzothiazole, 2-aminobenzothiazole, 2-amino-6-methoxybenzothiazole, 2-methyl-5-chlorobenzothiazole, 2-hydroxybenzothiazole, 2-amino-6-methylbenzothiazole, 2-chlorobenzothiazole, 2,5-dimethylbenzothiazole, 2-mercaptobenzothiazole, 6-nitro-2-mercaptobenzothiazole, 5-hydroxy-2-methylbenzothiazole, and 2-benzothiazolethioacetic acid.

Examples of pH regulators and buffering agents include various acids such as formic acid, acetic acid, propionic acid and like monocarboxylic acids; boric acids; phosphoric acids; oxalic acid, succinic acid and like dicarboxylic acids; lactic acid, tartaric acid, citric acid and like hydroxycarboxylic acids; hydrochloric acid and sulfuric acid; and various bases such as ammonia and sodium hydroxide.

Examples of electrically conductive salts include sodium salts, potassium salts, ammonium salts, amine salts and the like of sulfuric acid, hydrochloric acid, phosphoric acid, sulfamic acid, sulfonic acid and the like.

The amounts of the above additives to be added to the plating bath may be selected as appropriate from publicly known ranges thereof in accordance with the usage of the plating bath, for example barrel plating, rack plating, high-speed continuous plating, or rackless plating.

Moreover, publicly known amphoteric surfactants, non-ionic surfactants, low-molecular-weight cationic surfactants and the like may also be added to the gold-tin alloy plating bath of the present invention.

Plating Method

When electroplating is carried out using the gold-tin alloy plating bath of the present invention, the bath temperature is preferably at least 0° C., more preferably about 10 to 50° C. The cathode current density is preferably about 0.01 to 150 $A/dm^2$, more preferably about 0.1 to 30 $A/dm^2$. Within such a current density range, the higher the current density the higher the tin content in the gold-tin alloy plating film tends to be, and hence by setting the current density to an appropriate value, a plating film of a desired alloy composition can be formed.

The pH of the plating bath can be anywhere in a broad range from slightly acidic to alkaline.

There are no particular limitations on the anode, although platinum, carbon, titanium/platinum, titanium/rhodium or the like is preferable.

There are no particular limitations on the article to be plated using the plating bath of the present invention, although the article should be electrically conductive. Nevertheless, because the plating film formed from the plating bath of the present invention has good meltability and excellent reflow properties, it is particularly effective to use the plating film formed on connecting portions of the electronic components as the film for reflow soldering of electronic components. Specific examples of such an electronic component include chip components such as semiconductor integrated circuits, resistors, variable resistors, capacitors, filters, inductors, thermistors and quartz resonators, structural components such as connectors and switches, hoops, and wires (lead wires etc.).

As described above, the gold-tin alloy plating bath of the present invention is a non-cyanide-type plating bath, i.e. does not contain any cyanide compounds which are harmful to the human body, and is thus excellent in terms of work safety and environmental protection. Moreover, the gold-tin alloy plating film formed from the gold-tin alloy plating bath of the present invention is an excellent film having good brightness and little uneven deposit.

Furthermore, the gold-tin alloy plating film formed from the gold-tin alloy plating bath of the present invention has good reflow properties and high bonding strength, and hence is highly useful for reflow soldering of electronic components. In particular, an alloy film having a eutectic composition i.e., an Au:Sn ratio of 80:20 by weight, or a composition close to this ratio formed from the plating bath of the present invention can be widely used as a practical, low-melting-point, high-strength brazing material for electronic components such as semiconductor integrated circuits, switches, resistors, variable resistors, capacitors, inductors, thermistors and quartz resonators.

DESCRIPTION OF THE PREFERRED EMBODIMENTS

Following is a more detailed description of the present invention through examples.

In Examples 1 to 4 the type or amount of a quaternary ammonium salt of a diallylamine polymer is changed, in Examples 5 and 6 a quaternary ammonium salt of a diallylamine polymer is used in combination with a nonionic surfactant or an amphoteric surfactant, in Example 8 a dialkylhydroxyalkylaminoalkyl ammonium polymer is used as a cationic macromolecular surfactant, and in Example 9 a cellulose modified with quaternary ammonium salt is used as a cationic macromolecular compound. Moreover, in Example 7 only a water-soluble stannous compound is used as a tin compound, whereas in the other Examples a water-soluble stannous compound and a water-soluble stannic compound are used in combination.

Turning now to Comparative Examples 1 to 7, in Comparative Example 1 no cationic macromolecular surfactant or cationic macromolecular compound is used, in Comparative Examples 2, 3, 4, 6 and 7 a non-cationic macromolecular surfactant is used, and in Comparative Example 5 a low-molecular-weight cationic surfactant is used.

EXAMPLE 1

A gold-tin alloy plating bath having the following composition was prepared.

| | |
|---|---|
| Gold potassium sulfite (as Au*) | 7 g/l |
| Sodium sulfite | 0.5 mol/l |
| Stannous chloride dihydrate (as $Sn^{2+}$) | 0.1 mol/l |
| Stannic chloride pentahydrate (as $Sn^{4+}$) | 0.1 mol/l |
| Trisodium citrate dihydrate | 0.2 mol/l |

-continued

| | |
|---|---|
| Sodium gluconate | 0.2 mol/l |
| Cationic macromolecular surfactant * | 0.05 g/l |

* SHALLOL DC902P (trade name, made by DAI-ICHI KOGYO SEIYAKU Co., Ltd.) was used as the cationic macromolecular surfactant. SHALLOL DC902P contains as an active ingredient the quaternary ammonium salt of diallylamine polymer represented by above-mentioned general formula (1) with x = 0, y = 1, R = methyl, X = Cl, and weight average molecular weight of about 9,000; the solid content of SHALLOL DC902P is 50 to 53 wt %, and the viscosity is 200 to 1,800 mPa · s (25° C.)

EXAMPLE 2

A gold-tin alloy plating bath was prepared having the same composition as in Example 1 with the exception that 0.2 g/l of SHALLOL DC902P was used as the cationic macromolecular surfactant.

EXAMPLE 3

A gold-tin alloy plating bath was prepared having the same composition as in Example 1 with the exception that 0.2 g/l of SHALLOL DC303P (trade name, made by DAI-ICHI KOGYO SEIYAKU Co., Ltd.) was used as the cationic macromolecular surfactant in place of SHALLOL DC902P.

SHALLOL DC303P contains as an active ingredient the quaternary ammonium salt of diallylamine polymer represented by above-mentioned general formula (1) with x=0, y=1, R=methyl, X=Cl, and weight average molecular weight of about 30,000; the solid content of SHALLOL DC303P is 40 to 43 wt %, and the viscosity is 2,000 to 8,000 mPa·s (25° C.).

EXAMPLE 4

A gold-tin alloy plating bath was prepared having the same composition as in Example 1 with the exception that 0.2 g/l of ADEKA CATIOACE PD (trade name, made by ASAHI DENKA KOGYO K.K.) was used as the cationic macromolecular surfactant in place of SHALLOL DC902P.

ADEKA CATIOACE PD is a mixture of the quaternary ammonium salt of diallylamine polymer represented by above-mentioned general formula (1) with x=1, y=0, R=methyl and X=Cl, and the quaternary ammonium salt of diallylamine polymer represented by above-mentioned general formula (1) with x=0, y=1, R=methyl and X=Cl; weight average molecular weight is 40,000 to 50,000, and the degree of polymerization is 140 to 170; the solid content of ADEKA CATIOACE PD is 40 wt %, the viscosity is 10,000 mPa·s (25° C.).

EXAMPLE 5

A gold-tin alloy plating bath was prepared having the same composition as in Example 1 with the exception that 0.2 g/l of a nonionic surfactant (trade name: Trichol LAL8; made by Emery Industries) which is an ethylene oxide addition product of an alkyl ether was further added to the plating bath.

EXAMPLE 6

A gold-tin alloy plating bath was prepared having the same composition as in Example 1 with the exception that 0.2 g/l of a betaine type amphoteric surfactant (trade name: LEBON S; made by SANYO CHEMICAL INDUSTRIES) was further added to the plating bath.

EXAMPLE 7

A gold-tin alloy plating bath was prepared having the same composition as in Example 1 with the exception that stannic chloride pentahydrate was not used.

EXAMPLE 8

A gold-tin alloy plating bath was prepared having the same composition as in Example 1 with the exception that 0.2 g/l of a dialkylhydroxyalkylaminoalkyl ammonium polymer (trade name: HIMOLOC Q-101; made by HYMO CORPORATION) was used as the cationic macromolecular surfactant in place of SHALLOL DC902P.

EXAMPLE 9

A gold-tin alloy plating bath was prepared having the same composition as in Example 1 with the exception that 0.2 g/l of a quaternary-ammonium-salt-modified cellulose (trade name: Leoguard G; made by LION CORPORATION) was used in place of the cationic macromolecular surfactant.

COMPARATIVE EXAMPLE 1

A gold-tin alloy plating bath was prepared having the same composition as in Example 1 with the exception that the cationic macromolecular surfactant was not used.

COMPARATIVE EXAMPLE 2

A gold-tin alloy plating bath was prepared having the same composition as in Example 1 with the exception that 0.2 g/l of a nonionic macromolecular surfactant (trade name: Trichol LAL8; made by Emery Industries) was used in place of the cationic macromolecular surfactant.

COMPARATIVE EXAMPLE 3

A gold-tin alloy plating bath was prepared having the same composition as in Example 1 with the exception that 0.2 g/l of an alkylphenol polyethoxylate (nonionic macromolecular surfactant, trade name: Triton X100; made by Rohm and Haas Co.) was used in place of the cationic macromolecular surfactant.

COMPARATIVE EXAMPLE 4

A gold-tin alloy plating bath was prepared having the same composition as in Example 1 with the exception that 0.2 g/l of an alkylphenol polyethoxylate (nonionic macromolecular surfactant, trade name: Pionin D-625; made by TAKEMOTO OIL & FAT Co., Ltd.) was used in place of the cationic macromolecular surfactant.

COMPARATIVE EXAMPLE 5

A gold-tin alloy plating bath was prepared having the same composition as in Example 1 with the exception that 0.2 g/l of a benzalkonium chloride (cationic low-molecular-weight surfactant, trade name: Cation G-50; made by DAI-ICHI KOGYO SEIYAKU Co., Ltd.) was used in place of the cationic macromolecular surfactant.

COMPARATIVE EXAMPLE 6

A gold-tin alloy plating bath was prepared having the same composition as in Example 1 with the exception that 0.2 g/l of a polyvinyl alcohol (nonionic macromolecular surfactant, trade name: PVA #2000; made by KANTO CHEMICALS) was used in place of the cationic macromolecular surfactant.

COMPARATIVE EXAMPLE 7

A gold-tin alloy plating bath was prepared having the same composition as in Example 1 with the exception that 0.2 g/l of a polyacrylamide (nonionic macromolecular surfactant, trade name: Polystron 619; made by Arakawa Chemical Industries) was used in place of the cationic macromolecular surfactant.

An electroplated film of thickness about 10 $\mu$m was formed on a brass plate under the following conditions with strong agitation using each of the plating baths of above-mentioned Examples 1 to 3.

Bath temperature: 35° C.

pH: 9

Cathode Current density: 0.3 to 0.6 A/dm$^2$

Anode: Platinum/titanium

Moreover, with respect to the plating baths of Examples 4 to 9 and Comparative Examples 1 to 7, the same conditions as for the plating baths of Examples 1 to 3 were used with the exception that the current density was changed as follows to make the Sn content in the alloy about 20 wt %.

| | Cathode Current density (A/dm$^2$) |
|---|---|
| Example 4 | 0.6 |
| Example 5 | 0.3 |
| Example 6 | 0.6 |
| Example 7 | 0.3 |
| Example 8 | 0.6 |
| Example 9 | 0.5 |
| Comparative Example 1 | 0.7 |
| Comparative Example 2 | 0.3 |
| Comparative Example 3 | 0.3 |
| Comparative Example 4 | 0.3 |
| Comparative Example 5 | 0.4 |
| Comparative Example 6 | 0.3 |
| Comparative Example 7 | 0.7 |

The brightness and reflow properties of each of the gold-tin alloy plating films obtained as above were evaluated using the following methods. Moreover, the Sn content (wt %) in each of the gold-tin alloy plating films was me asured using X-ray-MA analysis (EMAX-5770W analyzer; made by Horiba) * Test methods and evaluation criteria (1) Brightness The electrodeposited film was visually examined and evaluated according to the following criteria.

A: Bright deposit, no dull appearance.

B: Semi-bright deposit, no dull appearance.

C: Bright or semi-bright deposit, but has partial dull appearance.

D: Mat, coarse electrodeposit.

(2) Reflow Properties

The base metal on which the electrodeposited film had been formed was placed on a hotplate, and heated for 1 minute at 350° C. in an air atmosphere. The melting of the gold-tin alloy plating film was observed, and evaluation was carried out in accordance with the following criteria.

A: Film melts immediately, and still has metallic luster after reflow.

B: Film melts after a few tens of seconds, but despite the rapid melting there is no metallic luster after reflow.

C: Film does not melt.

The results are shown below in Table 1.

TABLE 1

| | Brightness | Reflow properties | Sn content of Alloy film (wt %) |
|---|---|---|---|
| Example 1 | A | A | 21.0 |
| Example 2 | A | A | 21.5 |
| Example 3 | B | A | 22.3 |
| Example 4 | A | B | 23.6 |
| Example 5 | B | B | 24.2 |
| Example 6 | B | B | 20.8 |
| Example 7 | B | B | 21.2 |
| Example 8 | B | B | 21.5 |

TABLE 1-continued

| | Brightness | Reflow properties | Sn content of Alloy film (wt %) |
|---|---|---|---|
| Example 9 | B | B | 21.3 |
| Comp. Example 1 | D | C | 20.1 |
| Comp. Example 2 | C | C | 23.4 |
| Comp. Example 3 | C | C | 21.7 |
| Comp. Example 4 | C | C | 23.1 |
| Comp. Example 5 | C | C | 21.8 |
| Comp. Example 6 | D | C | 22.1 |
| Comp. Example 7 | Semi-bright | C | 20.7 |

As shown above, by using a non-cyanide-type plating bath containing a cationic macromolecular surfactant or a cationic macromolecular compound as in Examples 1 to 9, a gold-tin alloy plating film having excellent brightness and reflow properties can be formed.

What is claimed is:

1. A non-cyanide gold-tin alloy plating bath, comprising:

(i) at least one water-soluble gold compound;

(ii) at least one complexing agent for gold;

(iii) at least one water-soluble tin compound; and (iv) at least one component selected from the group consisting of cationic macromolecular surfactants and cationic macromolecular compounds.

2. The non-cyanide gold-tin alloy plating bath according to claim 1, wherein said cationic macromolecular surfactant is a quaternary ammonium salt of a diallylamine polymer.

3. The non-cyanide gold-tin alloy plating bath according to claim 1, wherein a mixture of at least one water-soluble stannous compound and at least one water-soluble stannic compound is used as the water-soluble tin compound.

4. The non-cyanide gold-tin alloy plating bath according to claim 1, further containing at least one additive selected from the group consisting of complexing agents for tin, masking agents, oxidation inhibitors, brightening agents, semi-brightening agents, pH regulators, buffering agents and electrically conductive salts.

5. A gold-tin alloy plating method comprising the step of applying an electric current, using an article to be plated as an cathode, in the non-cyanide gold-tin alloy plating bath according to any of claims 1 through 4.

* * * * *